United States Patent [19]

Johnson

[11] Patent Number: 5,019,950

[45] Date of Patent: May 28, 1991

[54] TIMED BEDSIDE NIGHT-LIGHT

[76] Inventor: Gerald L. R. Johnson, 6764 Manning Ave., N., Stillwater, Minn. 55082

[21] Appl. No.: 528,535

[22] Filed: May 25, 1990

[51] Int. Cl.[5] ..... A47B 23/06

[52] U.S. Cl. ..... 362/130; 362/153; 362/802; 200/85 R

[58] Field of Search ..... 362/802, 130, 153, 127, 362/145, 253, 801; 200/85 R, 86 R

[56] References Cited

U.S. PATENT DOCUMENTS

| | | | |
|---|---|---|---|
| 919,811 | 4/1909 | Beynon . | |
| 2,185,051 | 12/1939 | Daigle . | |
| 3,417,215 | 12/1968 | Corona . | |
| 3,965,465 | 6/1976 | Alexander | 362/802 |
| 4,172,216 | 10/1979 | O'Shea | 200/85 R |
| 4,264,904 | 4/1981 | McCoy et al. | 200/85 R |
| 4,378,476 | 3/1983 | Nicholas | 200/85 |
| 4,544,993 | 10/1985 | Kirk | 362/802 |
| 4,744,015 | 5/1988 | Lai | 362/153 |

OTHER PUBLICATIONS

U.S. Pat. No. 1989 Illustrated Catalog (3 Sheets).

*Primary Examiner*—Ira S. Lazarus
*Assistant Examiner*—Sue Hagarman
*Attorney, Agent, or Firm*—Plamatier & Sjoquist

[57] ABSTRACT

A timed bedside night-light combination is disclosed that turns on a bedside lamp when a person steps on a mat adjacent the bed and turns on a timer when the person steps off of the mat. The timer turns off the lamp after a predetermined period of time.

15 Claims, 1 Drawing Sheet

TIMED BEDSIDE NIGHT-LIGHT

The present invention relates to a timed bedside night-light and, more particularly, to an electronic timed bedside night-light combination which activates a timer for a light when a person steps off of a mat adjacent to a bed.

BACKGROUND OF THE INVENTION

Arthritic, handicapped or elderly persons often find it physically difficult to do simple, everyday tasks such as leaning over a nightstand and turning on a light switch. Furthermore, the elderly or those stricken with Alzheimer's disease may have memory lapses which prevent them from performing the everyday tasks.

SUMMARY OF THE INVENTION

A feature of the present invention is the provision in a timed bedside night-light combination having a mat with switch contacts for turning on the light, of a delay timer which is turned on when a person steps off of the mat and which turns off the light after a predetermined amount of time.

Another feature is a provision in such a timed bedside night-light combination, of the switch contacts including two parallel strips of electrically conductive material which are separated at intervals by resilient, nonconductive elements so that portions of the strips disposed between the elements are engagable with each other to complete a circuit.

Another feature is the provision in such a timed bedside night-light combination, of a delay timer including a delay adjustment means for adjusting the predetermined period of time.

Another feature is the provision in such a timed bedside night-light combination, of the switch contacts in the mat being operable on 12 volts.

An advantage of the present invention is an automatic operation of a light when climbing into or out of bed.

Another advantage is that the light remains on for a prescribed period of time to allow the elderly or handicapped person to read in bed or walk safely out of the bedroom.

Another advantage is that little care need be taken when stepping onto the mat to turn on the light. The mat is relatively large, and pressure on any foot-size portion of the mat turns on the light and activates the timer.

Another advantage is that the timed bedside night-light is simple and inexpensive to manufacture, and easy to operate.

DESCRIPTION OF THE PREFERRED EMBODIMENTS

Figure 1:
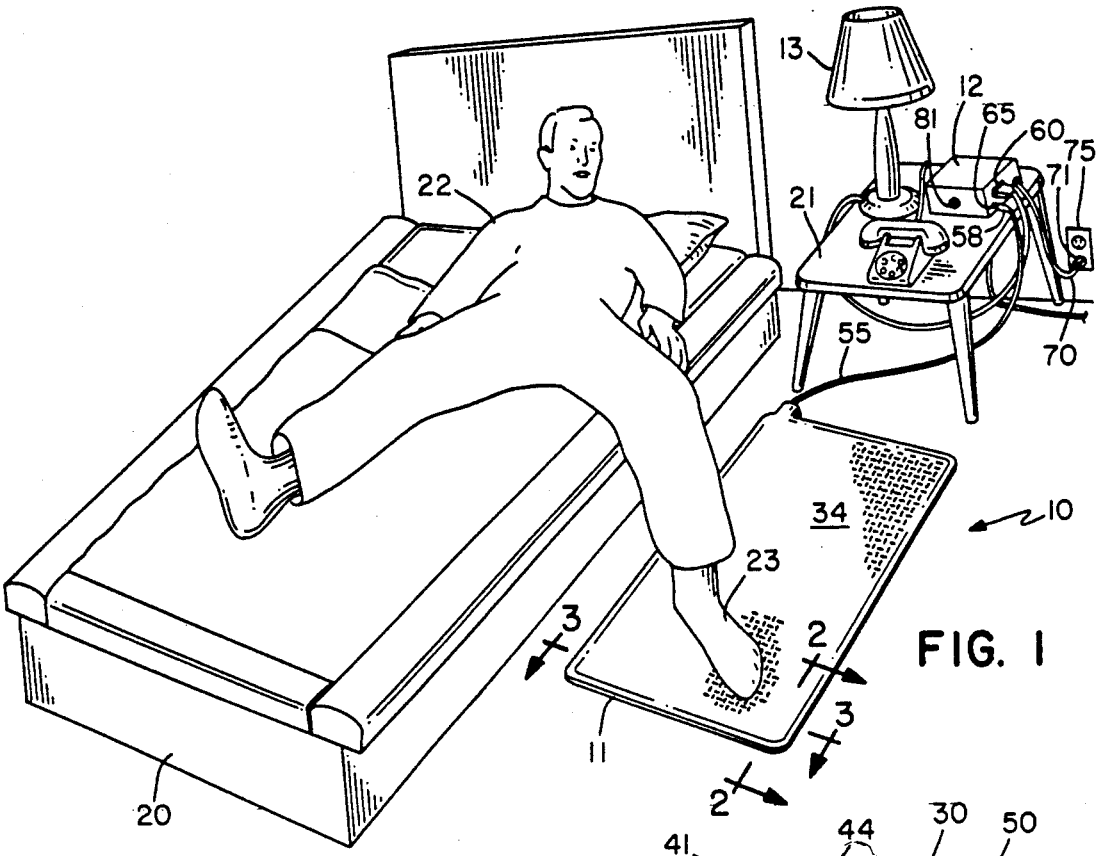
FIG. 1 is a perspective view of the timed bedside night-light.
Figure 2:
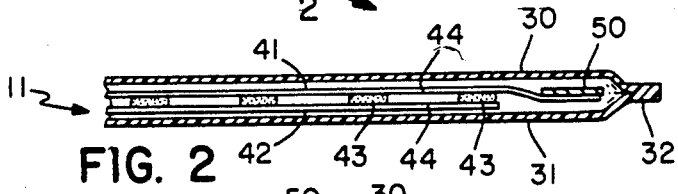
FIG. 2 is a section view at lines 2—2 of FIG. 1 showing one set of parallel strips of conductive material for the switch contacts.
Figure 3:
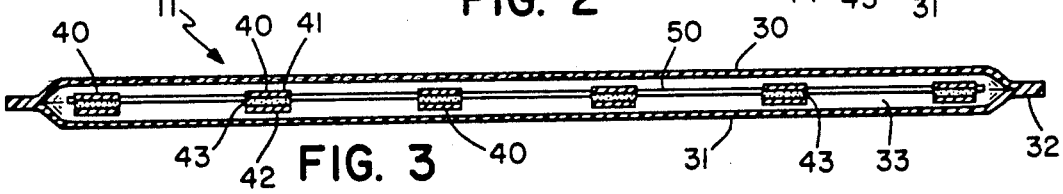
FIG. 3 is a section view at line 3—3 of FIG. 1 showing portions of each set of parallel conductive strips.
Figure 4:
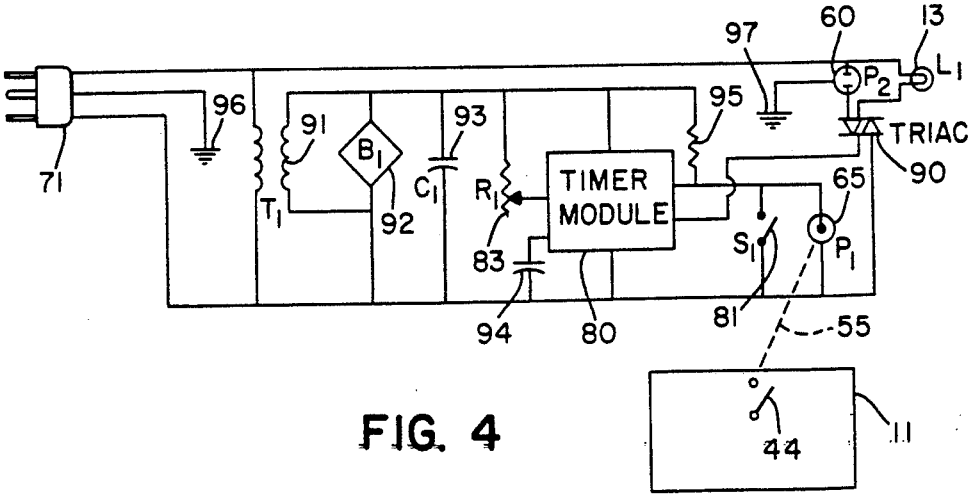
FIG. 4 is a circuit diagram of the timed bedside night-light combination of FIG. 1.

As shown in FIG. 1, the timed bedside night-light is indicated in general by the reference numeral 10. The timed bedside night-light combination 10 includes as its principal components a mat 11, a control box or control means 12 and a light 13. Foot pressure on the mat 11 turns on the light 13. The control box 12 turns off the light 13 after a predetermined period of time which starts when such foot pressure is removed from the mat 11.

The timed bedside night-light 10 is typically disposed adjacent a bed 20. The control box 12 and light 13 are typically placed on a table or nightstand 21. The mat 11 is disposed adjacent to the table 21 and bed 20. FIG. 1 shows a person 22 with a foot 23 bringing pressure to bear on the mat 11.

The mat 11 includes vinyl upper and lower layers 30, 31 which are sealed relative to each other at a periphery 32 to form a moisture-free interior 33. Each of the layers 30, 31 includes an outer surface 34 which is textured to minimize slipping. The mat 11 is rectangular and measures 18 inches in width and 24 inches in length. The thickness of the mat 11 is approximately one-eighth of an inch.

Mat 11 includes typically a set of six rows 40 of parallel strips 41, 42 of conductive material running lengthwise in the mat 11. Each of the strips 41, 42 is formed typically of stainless steel. One of the strips 41, 42 is a positive lead; the other strip is a negative lead. Each row 40 includes a plurality of pieces of nonconductive foam 43 disposed at regular intervals between the strips 41, 42. Portions of the strips 41, 42 disposed between the adjacent foam pieces 43 are engagable with each other to serve as switches or switch contacts 44 to complete or close a circuit in the mat 11. The switch contacts 44 are closed such as by the pressure of foot 23 on the upper layer 30 of the mat 11. When the foot 23 is removed from the mat 11, the switch contacts 44 are pushed apart and disconnected from each other by the resilient foam pieces 43. The switch contacts 44 are disposed in each foot-sized portion of the mat 11.

The mat 11 includes a pair of transverse support strips 50 of stainless steel affixed to and between the rows 40 for spacing the rows 40 apart from each other. One transverse strip 50 is affixed in one end of the mat 11 to connect the positive leads; the other strip 50 is affixed in the other end of the mat to connect the negative leads. The mat 11 further includes an electrical cord 55 extending therefrom and including a pair of leads connected to respective strips 41, 42. The cord 55 further includes a male plug 58 for connection to the control box 12.

The control box 12 includes an outlet 60 for the light 13, a female receptacle 65 for the male plug 58 for the mat 11, and a 110 volt electrical cord 70 with a male plug 71 for being plugged into a 110 volt wall outlet 75. The control box 12 further includes a time delay means or a timer module or delay timer 80 with an on/off switch 81 and time adjustment means or variable resistor 83. When the switches 44 and 81 are closed, the delay timer 80 is activated and in turn provides a switching signal to a switch device 90 to operate the light 13 on a 110 volts.

The delay adjustment means 83 may be set for a predetermined length of time such as from five seconds to one hour or more. The circuitry of the delay timer 80 is such that the predetermined period of time begins to run when the switch 44 is opened, i.e., when the person 22 steps off of mat 11. When the predetermined period of time expires, the delay timer 80 provides a switching signal to the switch device 90 to turn off the light 13.

The control box 12 further includes a transformer 91 whereby the timer 80 and switch 44 from the mat 11 operate at about 12 volts. The box 12 further includes a bridge rectifier 92, filter capacitors 93, 94, a resistor 95 and grounding means 96, 97 for the 110 volt plugs 91 and 110 volt outlet 60, respectively.

In operation, when it is desired to utilize the timed bedside night-light 10, the on/off switch 81 is opened. Subsequently, when a person gets into bed, the night-light 10 is set for the prescribed period of time. While the nightlight 10 is being set, the person may step on the mat 11 to turn on the lamp 13. While the lamp 13 is on, the person may walk across the room to turn off the ceiling light and then walk back across the still lit room to get into bed. When getting into bed, the person steps onto the mat 11, thereby turning on the switch device 90 which sets the delay timer 80. When the person steps off of the mat 11, the delay timer 80 is turned on and the person has sufficient time to get well settled in bed before the delay timer 80 turns off the lamp 13.

In the middle of the night, the person may get out of the bed to go to the bathroom to take a pill. When the person steps out of bed and onto the mat 11, the lamp 13 is turned on and stays on while the person goes to the bathroom to take the pill. The lamp 13 may stay on until the person returns if the prescribed period of time is sufficiently long. When the person gets back into bed, the mat 11 is stepped on and the switch device 90 sets the delay timer 80. When the person steps off of the mat 11 and into the bed, the delay timer 80 is turned on and the lamp 13 stays lit for the prescribed period of time.

In other words, pressure brought to bear on the mat 11, such as stepping onto the mat 11, brings portions of conductive strips 41, 42 to come into contact and close one of the switches 44. When one of the switches 44 is closed, the delay timer 80 is activated to provide a switching signal to the switch device 90 to turn on the light 13. When the pressure is removed from the mat 11, such as by stepping off of the mat 11, the closed strips 41, 42 are pushed apart by the resilient foam pieces 43 to open switch 44. When the switch 44 is opened, the timer 80 begins to run for the predetermined period of time. When the predetermined period of time expires, the timer 80 provides a switching signal to the switch device 90 which in turn switches off the light 13.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A timed bedside night-light combination comprising:

a lamp, a bedside mat on the floor adjacent the lamp and having pressure responsive normally open switch means therein and operating in response to pressure applied onto the mat as by a person stepping onto the mat, and control means connected between an electric power source and the lamp and comprising a delay timer, the control means connected to the switch means, the control means also comprising a switching device closing and opening to turn the lamp on and off, the switching device closing in response to operation of the switching means to turn the light on when the mat is stepped on, and the switching device opening in response to operation of the delay timer to turn the lamp off after a predetermined delay.

2. The combination according to claim 1, wherein the switch means operates a second time when pressure is removed from the mat as by a person stepping off the mat, and wherein the delay timer is prepared for operation in response to operation of the switching means in the mat as a person steps on the mat, and said timer commences the timing in response to the second operation of the switch means to hold the switching device closed for a predetermined time after which the switching device is opened and turns out the light.

3. A timed bedside night-light combination comprising:

an electric lamp, a bedside mat on the floor adjacent to the lamp and having switch contacts disposed throughout the mat such that foot pressure brought to bear on any foot-sized portion of the mat closes one on the switch contacts, the switch contacts being openable when such pressure is removed from the mat, and control means between a power source and the lamp and comprising a switch for the lamp and a delay timer, the switch being closed and turning on the lamp when one of the switch contacts is closed, the switch being opened and turning off the lamp upon sensing a switching signal, the delay timer being activated for a predetermined period of time when one of the switch contacts is opened and being deactivated when the predetermined period of time expires whereupon the delay timer provides the switching signal to the switch to turn off the lamp whereby the lamp is turned on when a person steps on the mat and turned off after the predetermined period of time which starts when the person steps off of the mat.

4. The combination according to claim 3, wherein the switch contacts include two parallel strips of electrically conductive material, the strips being separated at intervals with resilient, nonconductive elements, portions of the strips disposed between the elements being engagable with each other to complete a circuit.

5. The combination according to claim 3, wherein the delay timer includes a delay adjustment means for adjusting the predetermined period of time.

6. The combination according to claim 5, wherein the delay adjustment means includes a variable resistor.

7. The combination according to claim 5, wherein the delay adjustment means is adjustable between five seconds and sixty minutes.

8. The combination according to claim 3, wherein the mat and switch contacts are operable on approximately twelve volts produced by a transformer in the control means.

9. The combination according to claim 3, wherein the lamp is operable on approximately 110 volts.

10. The combination according to claim 3, wherein the thickness of the mat is approximately one-eighth of an inch.

11. The combination according to claim 3, wherein the mat is sealed to prevent moisture from activating the switch contacts.

12. The combination according to claim 3, wherein the mat includes upper and lower vinyl layers which are sealed relative to each other on their peripheries to provide a moisture free interior, and two parallel strips of stainless steel, the strips being separated at intervals with pieces of resilient foam, the strips being engagable with each other between the foam pieces to complete a circuit.

13. The combination according to claim 3, wherein the mat is at least eighteen inches in width and at least twenty-four inches in length.

14. The combination according to claim 3, and further comprising a bed, the mat and lamp and control means being adjacent to the bed.

15. A timed bedside night-light combination comprising a lamp adjacent to the bed and being operable on approximately 110 volts, a bedside mat or the floor adjacent to the lamp and having upper and lower vinyl layers, each of the layers having an outer surface and a periphery, the outer surfaces being textured, the layers being sealed relative to each other on their peripheries to provide a moisture-free interior, the height of the mat being approximately one-eighth of an inch, switch contacts disposed in the interior of the mat and including two parallel strips of stainless steel, the strips being separated at intervals with pieces of resilient foam, portions of the strips disposed between the pieces of resilient foam being engagable with each other to complete a circuit such that foot pressure brought to bear on any foot-sized portion of the mat closes one of the switch contacts, the switch contacts being openable when such pressure is removed from the mat, the switch contacts being operable on approximately twelve volts, and control means between a power source and the light and comprising a switch for the lamp and a delay timer, the switch being closed and turning on the lamp when one of the switch contacts is closed, the switch being opened and turning off the lamp upon sensing a switching signal, the delay timer being activated for a predetermined period of time when one of the switch contacts is opened, the delay timer being deactivated after the predetermined time has expired whereupon the delay timer provides the switching signal to the switch, the delay timer further including a delay adjustment means for adjusting the predetermined period of time, the control means further including a transformer such that the switch contacts are operable on about twelve volts whereby the lamp is turned on when a person steps on the mat and turned off after the predetermined period of time which starts when the person steps off of the mat.

* * * * *